United States Patent [19]

Illenberg et al.

[11] Patent Number: 4,564,829

[45] Date of Patent: Jan. 14, 1986

[54] RAILWAY SIGNALING RELAY

[75] Inventors: Cornelius J. Illenberg; Ronald W. Dinger, both of Rochester; David A. Kunde, Pittsford; Anthony V. Lucarelli, Rochester, all of N.Y.

[73] Assignee: General Signal Corp., Rochester, N.Y.

[21] Appl. No.: 546,244

[22] Filed: Oct. 28, 1983

[51] Int. Cl.[4] ..... H01H 51/08

[52] U.S. Cl. ..... 335/135; 335/136

[58] Field of Search ..... 335/135, 136, 137; 361/346

[56] References Cited

U.S. PATENT DOCUMENTS 2,258,122 10/1941 Merkel ..... 361/346

OTHER PUBLICATIONS

GRS Catalog 62-1, Type B and Type VTB Plug-In Relays, Oct. 1982, General Signal Corp.

*Primary Examiner*—Harold Broome

*Attorney, Agent, or Firm*—M. LuKacher; M. E. Kleinmam

[57] ABSTRACT

A railway signaling relay for use in vital circuits has a high percentage release (ratio of drop away current to pickup current between 70% and 80%) by arrangement of contact springs and their associated pressure and stop plates which provide trapped pressure in the contact springs affording the high percentage release characteristic without modification of the electrical or basic mechanical configuration of the relay and retaining its vital characteristics.

10 Claims, 5 Drawing Figures

CONTACT SPACES 1 & 3
DE-ENERGIZED POSITION $P_{TF}$ = FRONT TRAPPED PRESSURE - PRESSURE REQUIRED TO JUST LIFT FRONT CONTACT SPRING (A) OFF STOP PLATE (C) WITHOUT INFLUENCE OF PRESSURE PLATE (B).

$P_{FB}$ = BACK FINAL PRESSURE - PRESSURE REQUIRED TO JUST BREAK BACK CONTACT (D) FROM ITS CO-ACTING HEEL CONTACT (G).

CONTACT SPACE 2
DE-ENERGIZED POSITION $P_{TF}$ = FRONT TRAPPED PRESSURE - PRESSURE REQUIRED TO JUST LIFT FRONT CONTACT SPRING (A) OFF STOP PLATE (C) WITHOUT INFLUENCE OF PRESSURE PLATE (B).

$P_{FB}$ = BACK FINAL PRESSURE - PRESSURE REQUIRED TO JUST BREAK BACK CONTACT (D) FROM ITS CO-ACTING HEEL CONTACT (G).

CONTACT SPACES 1 & 3
ENERGIZED POSITION $P_{FF}$ = FRONT FINAL PRESSURE - PRESSURE REQUIRED TO JUST LIFT CONTACT SPRING (A) AND BREAK CONTACT WITH HEEL CONTACT ON SPRING (H).

$P_{TB}$ = TRAPPED BACK PRESSURE - PRESSURE REQUIRED TO JUST LIFT BACK CONTACT SPRING (D) OFF STOP PLATE (E) WITHOUT INFLUENCE OF PRESSURE PLATE (F).

CONTACT SPACE 2
ENERGIZED POSITION $P_{FF}$ = FRONT FINAL PRESSURE - PRESSURE REQUIRED TO JUST LIFT CONTACT SPRING (A) AND BREAK CONTACT WITH HEEL CONTACT ON SPRING (H).

$P_{TB}$ = TRAPPED BACK PRESSURE - PRESSURE REQUIRED TO JUST LIFT BACK CONTACT SPRING (D) OFF STOP PLATE (E) WITHOUT INFLUENCE OF PRESSURE PLATE (F).

RAILWAY SIGNALING RELAY

DESCRIPTION

The present invention relates to railway signaling relays and particularly to a vital relay having high percentage release characteristics wherein the ratio of the drop away (DA) current to the pickup (PU) current of the relay expressed as a percentage is between 70% and 80%.

The present invention is especially suitable for use in type B plug in relays for use in the vital circuits of railway signaling systems.

Vital railway signaling relays are relays which have a design which is accepted by the railway industry to provide vital operating characteristics. Such relays are guarded against failures such as the fusing or welding of their contacts, and, if they fail, the failure is to a safe or restrictive mode of operation. Such relays have armatures biased by springs and gravity so as to cause their contacts to assume a predetermined, safe condition with front contacts open and back contacts closed or made. The front and back contacts are also guarded by pressure plates and stop plates. The purpose of the pressure and stop plates is, primarily, to damp any vibration of the contacts associated therewith. For further information respecting such relays reference may be had to catalogs published by General Railway Signal Company a Unit of General Signal Corporation, Rochester, New York, USA 14692; for example, the catalog which is identified as "GRS Catalog 62-1". U.S. Pat. Nos. 2,258,122, issued Oct. 7, 1941 and 2,502,811 issued Apr. 4, 1950 also describe B type railway signaling relays having the arrangements of contact springs discussed above. Such relays however do not inherently provide high percentage release characteristics. When their magnetic structures, armatures and contact groups are designed to maintain their vital characteristics, the percentage release obtained is approximately 50%. A higher percentage release is desirable for some applications where higher shunting sensitivity is important, for example where occupancy information as to longer sections of track is feasible, as over long routes which carry light traffic.

An important consideration in providing high percentage release characteristics is the effect of a relay having such characteristics on the design of track circuits and other railway signaling circuits which incorporate them. It is desirable to maintain the same electrical as well as the same mechanical (form and fit -- into plug boards) typical for railway signaling relays.

The present invention accomplishes these objectives by utilizing components presently available in railway signaling relays, particularly the pressure and stop plates of the contact groups thereof, in unique operating relationships with the front and back contacts so as to afford high percentage release characteristics which are repeatable in manufacturing so that all relays have the same high percentage release (e.g. 75%) for which they are designed without requiring alterations of the magnetic structure, including the coils and there inductance and resistance, and without the need for special parts for relays having high percentage release characteristics. In this connection the use of special springs in order to change the characteristics of a relay has been proposed (see U.S. Pat. No. 2,346,751 issued Apr. 18, 1944), but not for the purpose of providing a railway signaling relay with high percentage release characteristics and not by means of the techniques which have been discovered in accordance with the invention.

A railway signaling relay embodying the invention has the usual groups of contact springs, some of which are moveable and others of which are front and back contacts. The front contacts are disposed between stop plates and pressure plates. The moveable contacts are connected to a pusher which is connected to an armature. A magnetic structure, including at least one coil for actuating the armature through an air gap when the relay is energized by current applied to the coil, is provided. Such energization raises the pusher and moveable contacts against downward spring and gravity bias. The relay is provided with high percentage release characteristics by virtue of relationship between the stop plates and the front contacts which applies trapped pressure to the front contacts when the relay is deenergized. This biases the front contacts in a downward direction. The stop plate of the back contacts is also connected thereto to apply trapped pressure to bias the back contacts in an upward direction when the relay is energized. The balance of forces due to the trapped pressure provides the high percentage release characteristics. Suitable the relay may pickup with 300 milliamps and drop away at 210 milliamps which is much higher than the typical 150 milliamp DA current. The coil of the relay may be the typical ½ ohm coil (when two parallel connected coils are used, as in conventional B relays). The vital characteristics of the relay is maintained. No parts are used which are special for the high percentage release characteristic.

The foregoing and other objects advantages and features of the present invention will become more apparent in the reading of the following description in connection with the accompanying drawings wherein a preferred embodiment of the invention is illustrated.

Figure 1:
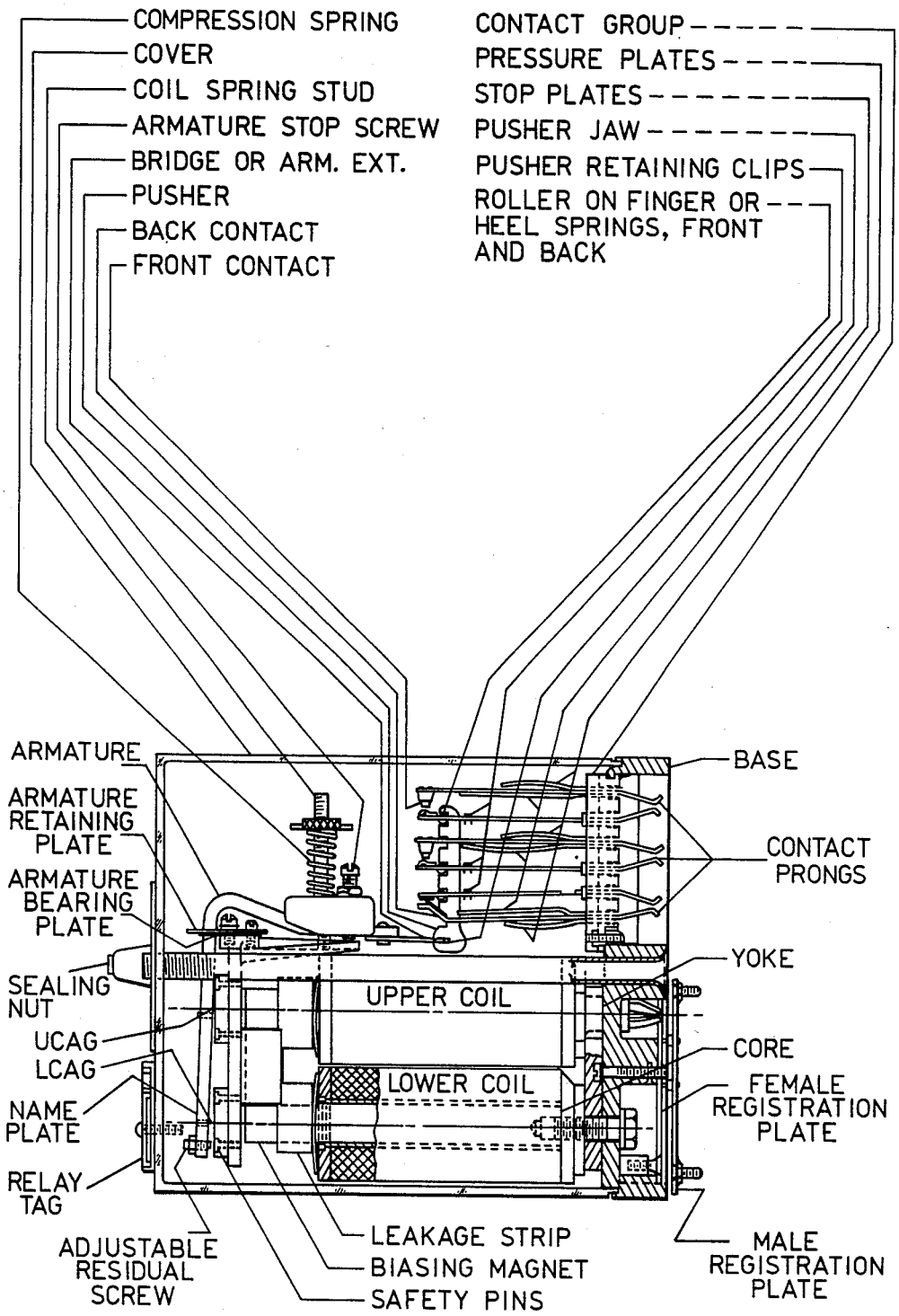
FIG. 1 is a side view of a type B1 biased neutral relay shown in deenergized position, the view has all parts labeled with nomenclature which is conventional, and generally accepted in the railway signaling art.

The relay shown in FIG. 1 is a B1 biased relay, where the parts are labeled with their nomenclature as known in the railway signaling art; thus no further reference numerals or description being necessary. For further information concerning the design and structure of the relay reference may be had to the above mentioned catalog and U.S. Pat. No. 2,258,122. The structure and arrangements which provide high percentage release characteristics are described in detail hereinafter.

Armature air gap (AG) is larger than typical. This relay employs a preliminary parallel 0.025" AG. The lower core AG (LCAG) is subsequently altered to a larger value, typical 0.030", than the upper core AG (UCAG). This AG arrangement enhances the specified drop away (DA) current value of the relay, and since the UCAG is smaller, the pick up (PU) current value is achieved by getting the armature in motion quicker than if a parallel AG were to be employed.

Figure 2:
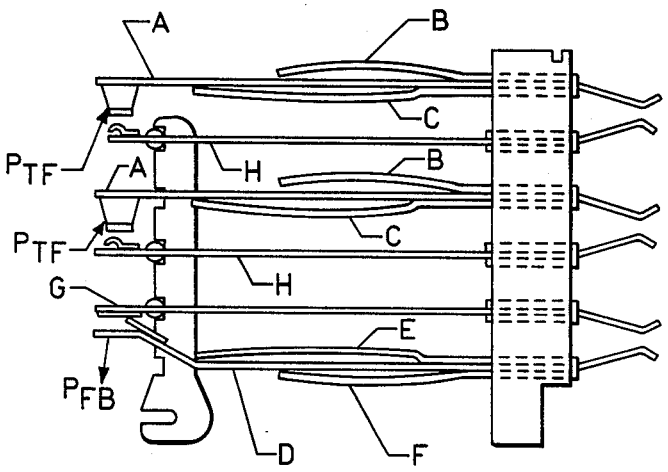
FIG. 2 is a side view of two, (the outside ones) of the contact groups of the relay shown in FIG. 1, in deenergized position.

Front and back contact trapped pressure is employed. Trapped pressure is the pressure between the contact spring and its associated stop plate due to the tension in the spring. Although mechanically it is a force, it is known as and referred to as a pressure in the railway signaling relay art. In the deenergized position (FIGS. 1, 2, and 3), the back contacts are all made and all front contacts are open. In this position, the back contacts are all experiencing final pressure ($P_{FB}$). This is the pressure, measured by a force (gram) gage pulling in the direction as shown by the arrows in the drawing, required to just break the back contact (D) from its co-acting heel contact (G). Also, in this relay position all front contacts are experiencing trapped pressure ($P_{TF}$). This is the pressure, measured as shown, required to just lift front contact spring (A) from stop plate (C). In the deenergized position, the front pressure plates (B) and back pressure plates (F) are adjusted to just not touch their associated contact springs.

When energy is initially applied to the relay coils (connected in parallel for 0.5 ohm operation) the armature is attracted to the relay cores. As the armature starts to move, the armature extension (ARM. EXT. see FIG. 1) begins to operate the pusher, which moves the heel springs in the upward position. As the back heel springs (G) begin to move, the pressure ($P_{FB}$) that was initially present is reduced quickly until the back contact spring (D) engages its stop plate (E). At this point trapped pressure ($P_{TB}$) is developed. This pressure is less than final pressure. This trapped pressure will later aid in the "push-off" of the armature during the removal of relay energy, since it assists the force from the armature and pushes tending to make the back contacts. At the same time this action is happening to all back contacts, the front contacts play no part in relay operation. The front contacts only come into play when the front heel springs (H) contact begins to co-act with their associated front contacts on springs (A). When this happens the existing front contact pressure ($P_{TF}$) builds up to final contact pressure ($P_{FF}$) as the pusher drives the front spring (A) against its pressure plate (B). For the front contacts, trapped pressure normally is in the 20–35 gram range while final pressure is in the 50–75 gram range. This extra pressure will also aid in the "push-off" of the armature during the removal of relay energy.

The operation of this relay is in steps. As the relay is being energized it will step smoothly until the front contacts are made. When this happens, a very noticeable step in operating values will be noticed to overcome the increasing front contact pressure. That is why this relay is allowed to have separate PU and working current (WC) values.

When energy is removed from the relay coils the armature will be aided in its break away from the cores by the large front contact pressure and by trapped back contact pressure. This is the reason this relay is capable of a high percentage release (e.g. 72% minimum).

Figure 3:
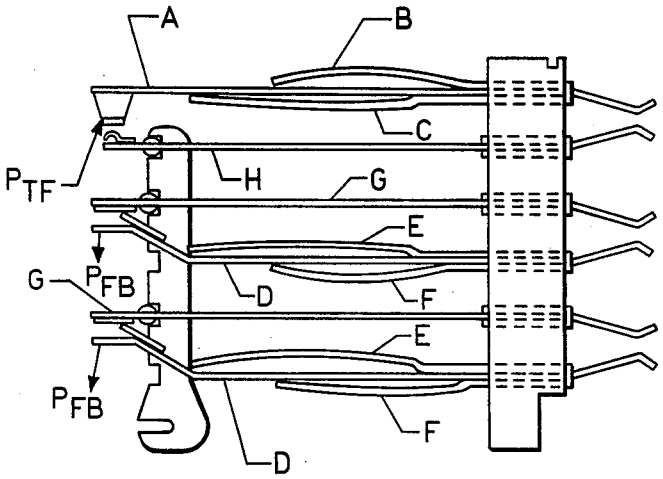
FIG. 3 is a side view of the center one of the contact groups in deenergized position.
Figure 4:
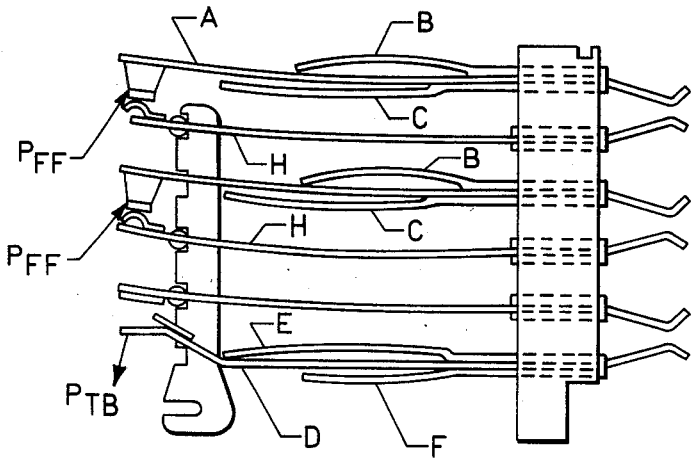
FIG. 4 is a side view of the two outside contact groups in energized position.
Figure 5:
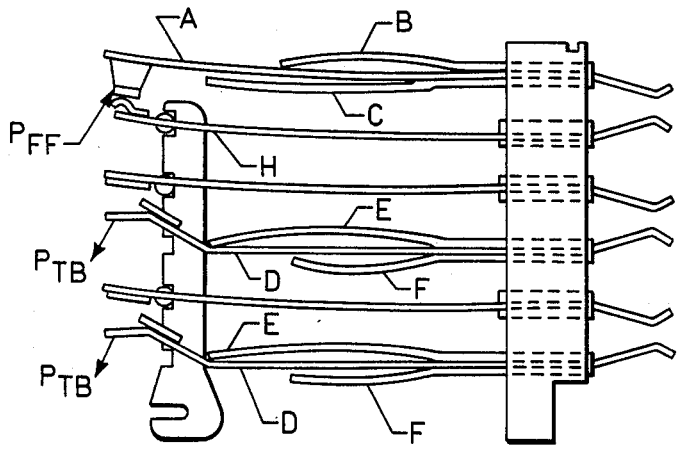
FIG. 5 is a side view of the center contact group in energized position.

This relay also utilizes another arrangement, provided by adjusting technique. For both the front and back contacts, their associated pressure plates (B) and (F) are reformed (flattened) during adjustment to extend the tips at their free ends to engage the contact spring closer to the contact end of the spring. This arrangement allows pressure to build up more quickly because the spring working length is reduced. This relays contact configuration has five front (5F) and four back (4B) contacts arranged in three contact groups: The outer sets (1) & (3) as shown in FIG. 1 and in FIGS. 2 and 4; and the inner set as shown in FIGS. 3 and 5. This is necessary to achieve the pressure balance necessary to achieve the specified ratio of PU and DA values for high percentage release.

From the foregoing description it will be apparent that a unique railway signalling relay has been provided. This relay has repeatable, vital characteristics which are the same from relay to relay of the design herein disclosed. The design does not effect the electrical characteristics are the size, shape and fit requirements from what is typical for standard plug in B relays. Accordingly, high percentage relays characteristics are obtained without requiring redesign of existing railway signaling relay circuits or installations.

We claim:

1. In a railway signalling relay having contacts provided by a plurality of contact springs some of which are moveable and others of which are front and back contacts, said front contacts being disposed between stop plates and pressure plates, said moveable contacts being connected to a pusher which is connected to an armature, a magnetic structure including at least one coil for said armature attracting said armature through an air gap when said relay in energized by current applied to said coil to raise said pusher and moveable contacts against downward spring and gravity bias, the improvement for providing said relay with high percentage release characteristics which comprises said stop plates of said front contacts being connected thereto to apply trapped pressure thereto when said relay is deenergized for biasing said front contacts in a downward direction, said stop plates of said back contacts being connected thereto to apply trapped pressure to bias said back contacts in an upward direction when said relay is energized.

2. The invention as set forth in claim 1 wherein said relay has at least three of said pluralities of contacts which define three groups of contacts vertically arranged in side by side relationship and operated by the same magnetic structure, armature and pusher, said groups each having six contact springs and said three groups defining five front and four back contacts.

3. The invention as set forth in claim 2 wherein one of said contact groups have one front and two back contacts and is disposed between the others of said contact groups, said other contact groups each having two front and one back contact.

4. The invention as set forth in claim 1 wherein said pressure plates of said front contacts are connected to said front contacts when said relay is energized to provide trapped pressure in the downward direction greater than said trapped pressure therein when said relay is deenergized.

5. The invention as set forth in claim 1 wherein said trapped pressure in said front contacts has a magnitude sufficient to just lift the front contacts upwardly off their stop plates, and wherein said trapped pressure in said back contacts has a magnitude just sufficient to pull said back contacts downwardly to break engagement between said back contact and the moveable contact in contacting relationship therewith.

6. The invention as set forth in claim 4 wherein said trapped pressure in said front contacts has a magnitude sufficient to just lift the front contacts upwardly off their stop plates, and wherein said trapped pressure in said back contacts has a magnitude just sufficient to pull said back contacts downwardly to break engagement between said back contact and the moveable contact in contacting relationship therewith, and wherein said trapped pressure in said front contacts when said relay in energized has a magnitude just sufficient to lift said front contacts out of contact with the moveable contacts in contacting relationship therewith.

7. The invention as set forth in claim 1 wherein said stop plates of said back contacts are in contacting relationship therewith when said relay is energized to provide trapped pressure in an upward direction of a magnitude just sufficient to lift the back contact from said stop plate thereof.

8. The invention as set forth in claim 7 wherein said pressure plates are spaced from their respective front and back contacts when said relay in deenergized just out of touching relationship therewith.

9. The invention as set forth in claim 1 wherein said magnetic structure as a pair of coils having their axes parallel, in the same vertical plane, and spaced above from each other, said armature being pivotly mounted on said structure to define first and second air gaps between said armature and the upper and lower one of said coils respectively, said first air gap being smaller than said second air gap.

10. The invention as set forth in claim 1 wherein said pressure plates are essentially flat so as to locate their tips and the free ends of the contacts associated therewith in closest proximity to each other.

* * * * *